US008284179B2

(12) United States Patent
Chen

(10) Patent No.: US 8,284,179 B2
(45) Date of Patent: Oct. 9, 2012

(54) TIMING CONTROLLER FOR REDUCING POWER CONSUMPTION AND DISPLAY DEVICE HAVING THE SAME

(75) Inventor: Shih-Po Chen, Tainan (TW)

(73) Assignee: Himax Technologies Limited, Tainan (TW)

( * ) Notice: Subject to any disclaimer, the term of this patent is extended or adjusted under 35 U.S.C. 154(b) by 990 days.

(21) Appl. No.: 12/035,244

(22) Filed: Feb. 21, 2008

(65) Prior Publication Data

US 2009/0213033 A1 Aug. 27, 2009

(51) Int. Cl.
*G09G 5/00* (2006.01)

(52) U.S. Cl. ..... 345/211; 345/99; 345/212; 345/213

(58) Field of Classification Search ..... 345/204–214, 345/530–547, 1.1; 713/300, 310, 320–324, 713/330, 340
See application file for complete search history.

(56) References Cited

U.S. PATENT DOCUMENTS

| | | | | |
|---|---|---|---|---|
| 5,757,365 | A * | 5/1998 | Ho | 345/212 |
| 6,971,034 | B2 * | 11/2005 | Samson et al. | 713/300 |
| 7,598,959 | B2 * | 10/2009 | Kardach et al. | 345/534 |
| 7,613,941 | B2 * | 11/2009 | Samson et al. | 713/323 |
| 7,840,827 | B2 * | 11/2010 | Dahan et al. | 713/324 |
| 2004/0075622 | A1 * | 4/2004 | Shiuan et al. | 345/1.1 |
| 2004/0075653 | A1 * | 4/2004 | Shiuan et al. | 345/204 |
| 2005/0225556 | A1 * | 10/2005 | Booth, Jr. | 345/537 |
| 2006/0187226 | A1 * | 8/2006 | Bruno et al. | 345/534 |
| 2008/0007561 | A1 * | 1/2008 | Thompson | 345/557 |
| 2008/0100636 | A1 * | 5/2008 | Lai et al. | 345/546 |
| 2011/0173472 | A1 * | 7/2011 | Ogura | 713/323 |

* cited by examiner

*Primary Examiner* — Amare Mengistu
*Assistant Examiner* — Rodney Amadiz
(74) *Attorney, Agent, or Firm* — Baker & McKenzie LLP

(57) ABSTRACT

The invention provides a display device with reduced power consumption, comprising a host applied to generate a first image signal, a timing controller connected to the host, applied to generate a second image signal and comprised a memory for storing image data, and a panel connected to the timing controller and applied to receive the second image signal for displaying image frames. When the display device is in a power-saving mode, the host is powered down, and the timing controller generates the second image signal according to the image data stored in the memory and outputs the second image signal to the panel.

17 Claims, 6 Drawing Sheets

TIMING CONTROLLER FOR REDUCING POWER CONSUMPTION AND DISPLAY DEVICE HAVING THE SAME

BACKGROUND OF THE INVENTION

1. Field of the Invention

The invention relates to a liquid crystal display and more particularly to a timing controller having reduced power consumption and an LCD device having the timing controller.

2. Description of the Related Art

A liquid crystal display (LCD) device is widely used in various electronic equipments as a thin and light-weight flat display. LCD devices include a host for generating an image signal, a timing controller converting the image signal, and a liquid crystal display panel for displaying image frame corresponding to converted image signal. In recent years, different kinds of LCD devices have been developed by display manufacturers. Most of these manufacturers are trying to reduce the power consumption of the LCD device so that the LCD device will become more suitable for portable electronic products such as cell phones, PDAs and E-books.

BRIEF SUMMARY OF THE INVENTION

The invention provides a display device capable of operating in normal mode and power-saving mode, thus having reduced power consumption.

The invention provides a timing controller. The timing controller is applied to receive a first image signal from a host and to provide a second image signal to a panel. The timing controller comprises a memory for storing image data. When the host is powered down, the timing controller generates the second image signal according to the image data stored in the memory.

The invention also provides a display device. The display device comprises a host that generates a first image signal, a timing controller that connects to the host generates a second image signal and comprises a memory for storing image data, and a panel that connects to the timing controller and receives the second image signal for displaying image frames. When the display device is in a power-saving mode, the host is powered down, and the timing controller generates the second image signal according to the image data stored in the memory and outputs the second image signal to the panel.

With the implementation of the memory inside the timing controller to store image data, even when the host is powered down the panel is still able to display image frames generated according to the image data. Meanwhile, the frame rate can be decreased to further reduce power consumption.

BRIEF DESCRIPTION OF THE DRAWINGS

The invention can be better understood by reading the subsequent detailed description and examples with references made to the accompanying drawings, wherein.

DETAILED DESCRIPTION OF THE INVENTION

Figure 1:
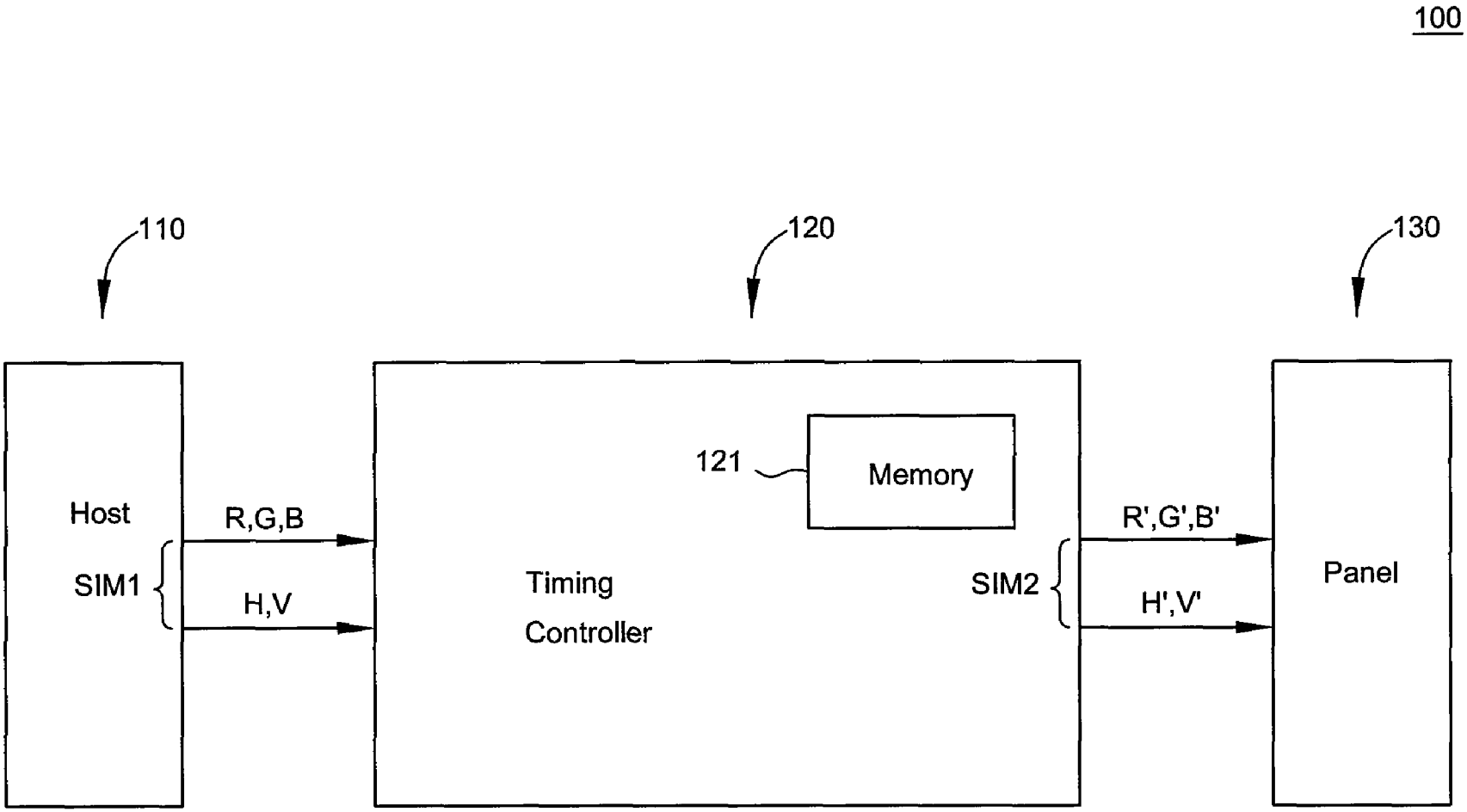
FIG. 1 is a schematic diagram of a display device in accordance with an embodiment of the invention.

FIG. 1 is a schematic diagram of a display device in accordance with an embodiment of the invention. In FIG. 1, the display device 100 comprises a host 110, a timing controller 120 and a panel 130. The host 110, such as a video graphics array (VGA) system, is configured to generate a first image signal SIM1, wherein the first image signal SIM1 comprises image information, i.e. video signals R, G and B, and timing controlling information, i.e. a vertical synchronizing signal V and a horizontal synchronizing signal H. The timing controller 120 is arranged between the host 110 and the panel 130 to convert the first image signal SIM1 to a second image signal SIM2 and then apply the second image signal SIM2 to the panel 130, wherein the second image signal SIM2 comprises image information, i.e. video signals R', G', B', and timing controlling information, i.e. a vertical synchronizing signal V', and a horizontal synchronizing signal H'. The timing controller 120 also comprises a memory 121 configured to store image data. The panel 130, such as a liquid crystal display (LCD) panel, is configured to display image frames corresponding to the second image signal SIM2.

The display device 100 is capable of operating in two different modes: a normal mode in which the host 110 is powered to generate the first image signal SIM1, and a power-saving mode in which the host 110 is powered down to stop generating the first image signal SIM1. As is described below in connection with FIG. 2, with the implementation of the memory 121 for storing image data during the normal mode, even when the display device 100 operates in the power-saving mode such that the timing controller 120 does not cannot to receive the first image signal SIM1, the timing controller 120 is still capable of generating the second image signal SIM2 according the image data previously stored in the memory 121. The panel 130 is thus still capable of displaying image frames corresponding to the second image signal SIM2. Accordingly, power consumption of the display device 100 is reduced compared to conventional display devices having a host powered continuously to generate image signal.

Figure 2:
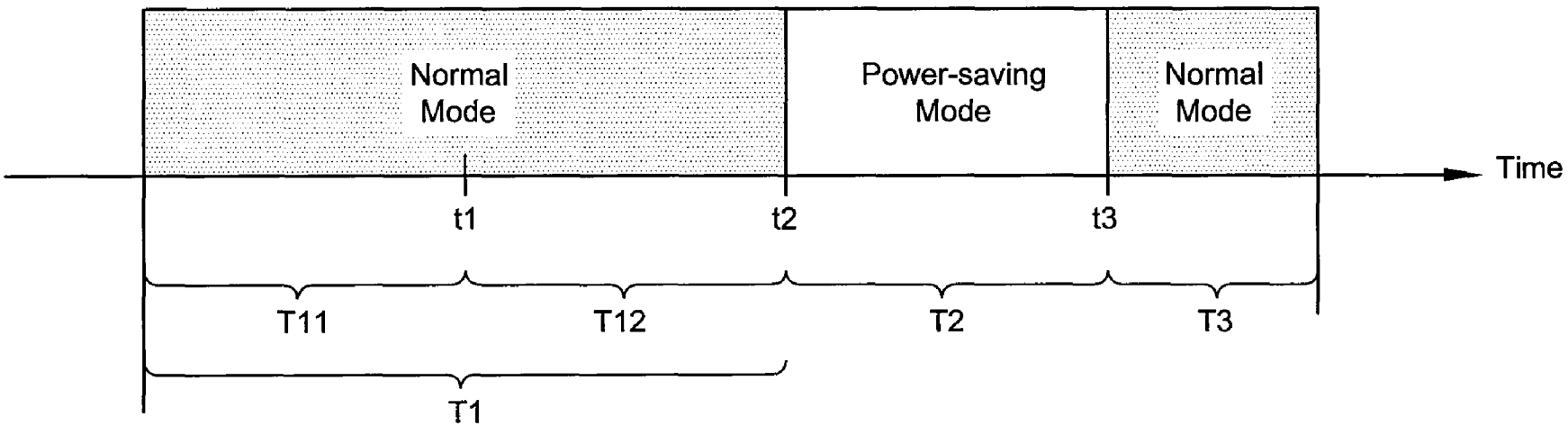
FIG. 2 is a diagram for explaining operations of the display device of FIG. 1 in different modes in accordance with an embodiment of the invention.

FIG. 2 is a diagram for explaining operations of the display device 100 of FIG. 1 in different modes. Referring simultaneously to FIGS. 1 and 2, the display device 100 operates in normal mode during period T1 first, and then operates in power-saving mode during period T2, and returns to operate in normal mode during period T3.

During period T11, the preceding part of the period T1, the host 110 generates a first image signal SIM1 and applied it to the timing controller 120. The timing controller 120 then converts the first image signal SIM1 to a second image signal SIM2 and provides the second image signal SIM2 to the panel 130. The panel 130 then displays image frames corresponding to the second image signal SIM2. During the period T11, the timing controller 120 neither generates nor stores any image data in the memory 121 during the period T11.

These operations continue until time t1 at which the host 110 is informed to switch to power-saving mode. However, before the display device 100 operates in the power-saving mode, a preparation process is performed in period T12 to prepare image data in the memory 121 that will be used to generate the second image signal SIM2 in the power-saving mode. After the host 110 is informed to enter the power saving-mode at time t1, it immediately notifies the timing controller 120 to generate image data and store the image data in the memory 121. Note that except from adding the operation of generating and storing the image data, the other operations described in period T11 are continued. More specifically, the host 110 continues to generate the first image signal SIM1, the timing controller 120 continues to convert the first image signal SIM1 to the second image signal SIM2 and simultaneously generates and stores image data in the memory 121, and the panel 130 continues to receive the second image signal to display image frames corresponding to the second image signal SIM2.

These operations continue until time t2 at which the host 100 is powered down to stop generating the first image signal SIM1, and the display device begins to operate in power saving mode. In period T2, timing controller 110 fetches the image data stored in the memory 121 and generates the second image signal SIM2 according to the stored image data. Similar to that in period T1, The panel 130 receives the second image signal SIM2 and displays image frames corresponding to the second image signal SIM2.

Various conditions can be used to determine the time t2. In an embodiment, the timing controller 120 checks the amount of the image data stored in the memory 121 after time t1. As soon as the timing controller 120 detects that the image data stored in the memory reaches a predetermined amount, it directs the host 110 to be powered down. The predetermined amount can be set by the host 110. Preferably, immediately after time t1, the host 110 provides the timing controller 120 with a signal corresponding to the predetermined amount.

Preferably, the timing controller 121 generates the image data according to one of the first image signal SIM1 and the second image signal SIM2 in period T12 because either image signal SIM1 or SIM2 includes image information (R, G, B or R', G', B') that can be used to generate image frames.

In addition, when the timing controller 120 generates the image data in period T12, it may process the first image signal SIM1 or the second image signal SIM2 to convert either signal to different data form as required. In other words, in period T12, the timing controller 120 may employ the information carried by the first image signal SIM1 or the second image signal SIM2 directly as the image data, or it may convert the information carried by the first image signal SIM1 or the second image signal SIM2 as the image data.

Similarly, when the timing controller 120 generates the second image signal SIM2 according to the image data in period T2, the timing controller 120 may process the image data to convert it to different data form as required. In other words, the timing controller 120 may employ image data stored in period T12 directly as part of the second image signal SIM2, or it may convert the image data to part of the second image signal SIM2.

Note that the image data stored during period T12 is not required to involve all information necessary to generate the second image signal SIM2 during period T2. In addition, not all the information carried by the first or second image signal SIM1 or SIM2 is used to generate the image data. In preferred embodiments, in period T12, the timing controller 120 generates image data including only image related information but no timing controlling related information. And then in period T2, the image data (or the image related information) is used by the timing controller 120 to generate only the image information R', G', B' of the second image signal SIM2. Timing controlling information H', V' of the second image signal SIM2 need to be acquired directly or generated separately from another source in period T2 in such embodiments. For example, the data required to generate the timing controlling information H', V' can be stored in the timing controller 120, or it can be stored in a memory outside the timing controller 120 and can be fetched by the timing controller 120 during period T2.

In a more preferable embodiment, in period T12, the timing controller 120 employs image information R' G', B' of the second image signal SIM2 directly as the image data. And then in period T2, the timing controller 120 acquires internally or externally the predetermined timing controlling data and employs the predetermined timing controlling data as timing controlling information of the second image signal SIM2. Simultaneously, the timing controller 120 employs the image data stored in period T12 as image information of the second image signal SIM2. Accordingly, image frames displayed during T2 can be the same as those during period T12. In the embodiment, no conversion process is required to generate the image data in period T12 and to generate the second image signal SIM2 in period T2. Process time and power consumption can thus be saved.

At time t3, the host 110 is powered on again to generate the first image signal SIM1 and the display device 100 returns to normal mode. The operations in the display device 100 during period T3 are similar to those during period T1 and are thus omitted for reasons of brevity.

It is not required to generate the image data according to one of the image signal SIM1 and SIM2 during period T12. For example, in other embodiments, image data different from the first and second image signal SIM1 and SIM2 can be generated additionally by the host 110 and then sent directly, or through the buffer controller 326, to the memory 121. In these embodiments, image frames during T12 and T2 are different.

Figure 3:
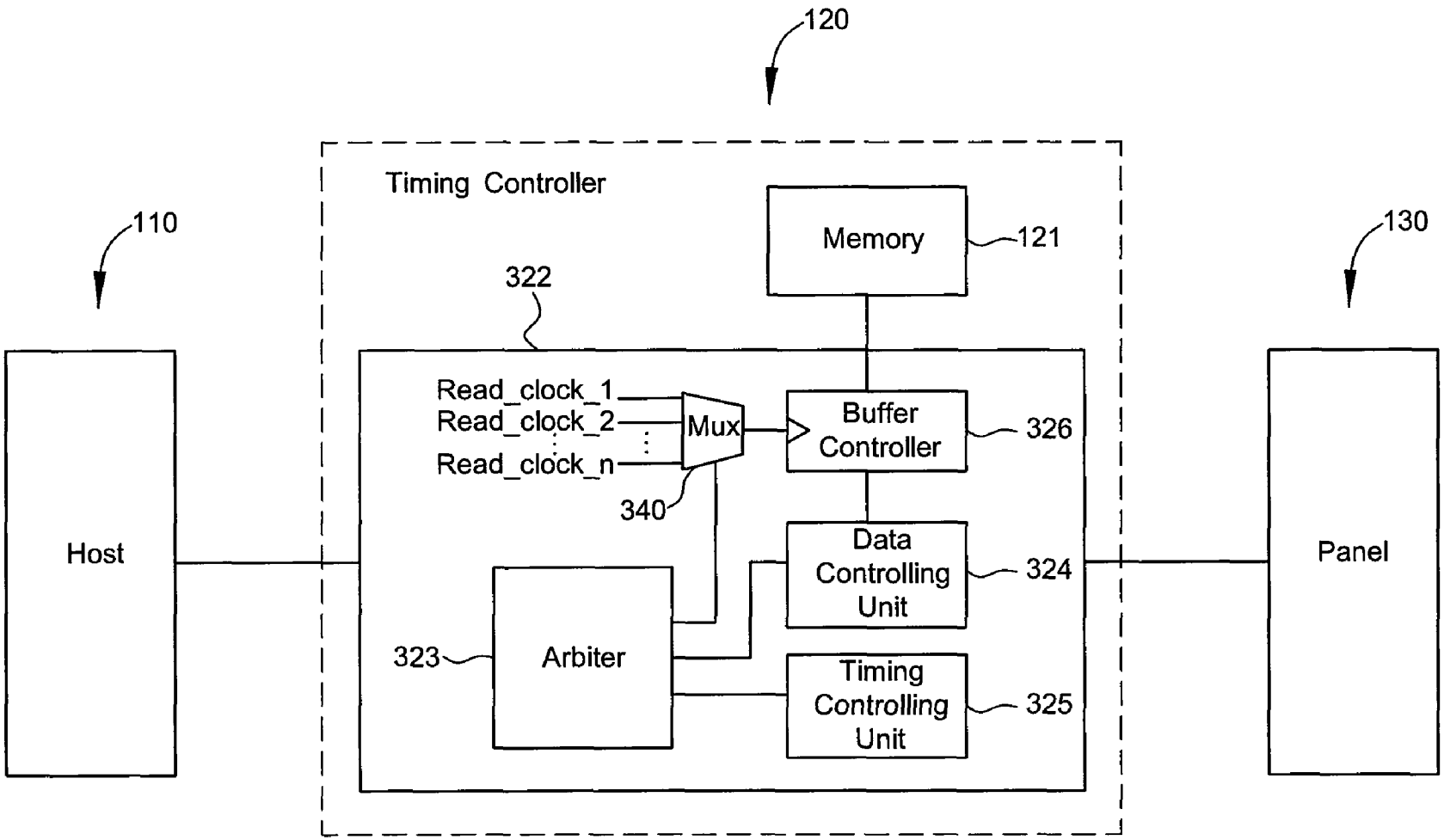
FIG. 3 is a more-detailed block diagram of the timing controller of FIG. 1 in accordance with an embodiment of the invention.

FIG. 3 is a more-detailed block diagram of the timing controller 120 of FIG. 1 in accordance with an embodiment of the invention. As shown, the timing controller 120 comprises a memory 121, an arbiter 323, a data controlling unit 324, a timing controlling unit 325, and a buffer controller 326. Preferably, but not necessarily, the arbiter 323, the data controlling unit 324, the timing controlling unit 325, and the buffer controller 326 are integrated into one driving integrated circuit 322. The arbiter 323 is controlled by the host 110 to administrate operations of the data controlling unit 324, the timing controlling unit 325 and the buffer controller 326. There is predetermined timing controlling data stored in the timing controlling unit 325.

Figure 4A:
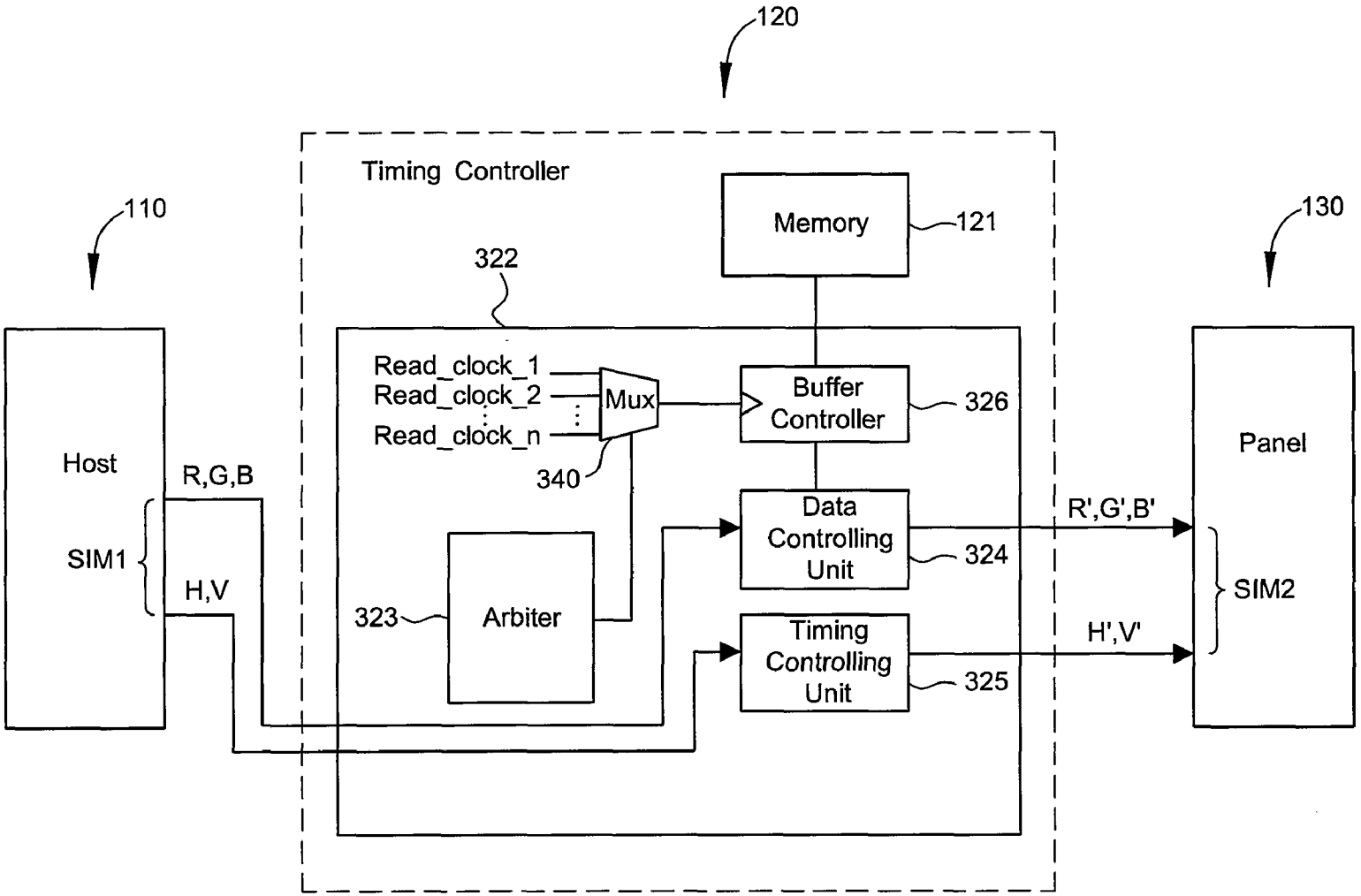
FIGS. 4A-4C illustrate detailed operations inside the LCD device of FIG. 1 employing the timing controller of FIG. 3 during different periods of FIG. 2 in accordance with an embodiment of the invention.
Figure 4B:
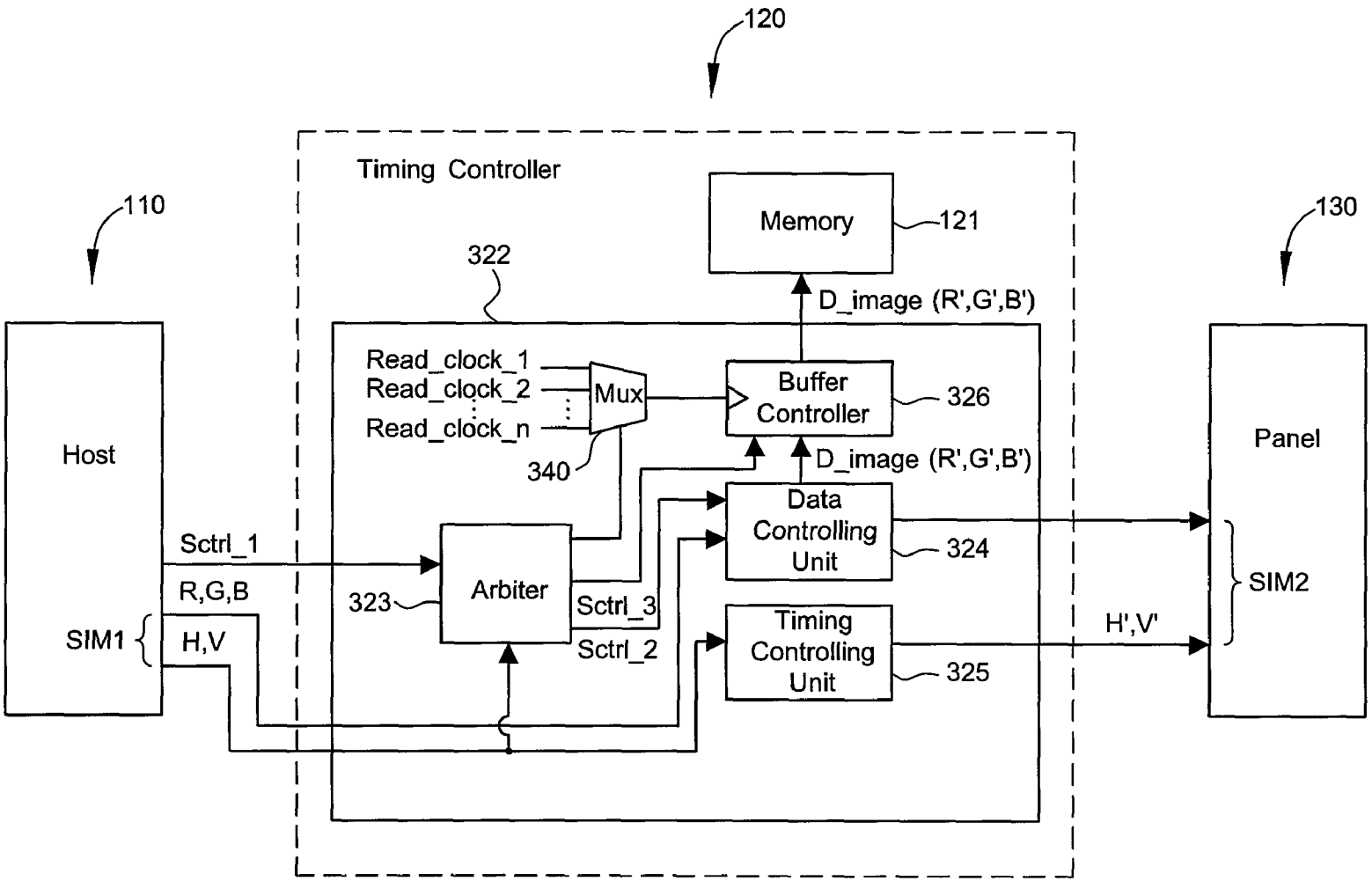
Figure 4C:
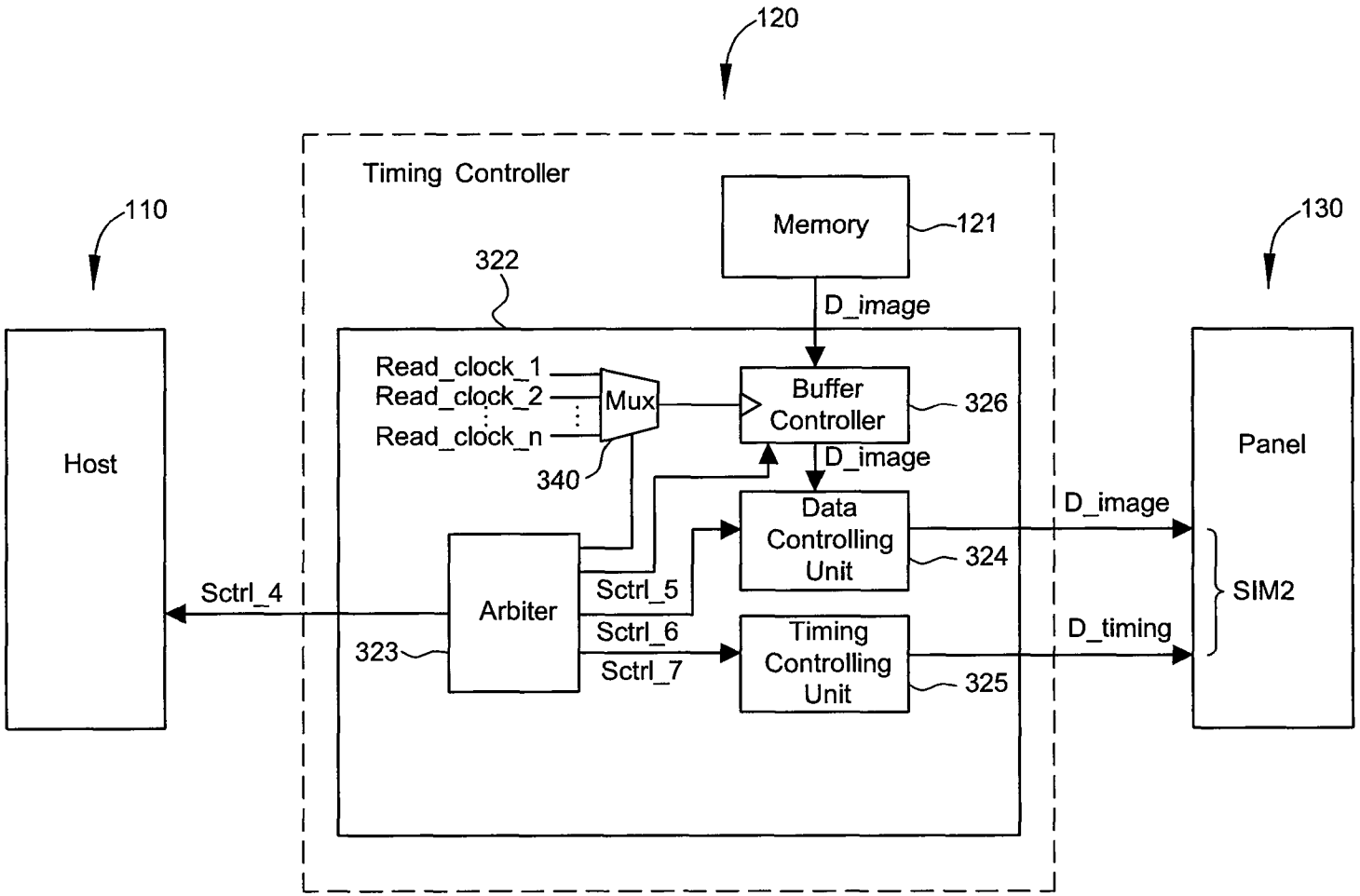

FIGS. 4A-4C illustrate detailed operations inside the LCD device 100 of FIG. 1 employing the timing controller 120 of FIG. 3 respectively when the LCD device 100 operates in the periods T11, T12, and T2 of FIG. 2 in accordance with an embodiment of the invention.

Refer simultaneously to FIGS. 2 and 4A first. During period T11, the host 110 generates a first image signal SIM1 comprising image information, i.e. video signals R, G and B, and timing controlling information, i.e. a vertical synchronizing signal V and a horizontal synchronizing signal H. The host 110 then applies the video signals R, G and B to the data controlling unit 324 and applies the synchronizing signals V and H to the timing controlling unit 325. The data controlling unit 324 then converts the video signals R, G and B to video signals R', G' and B' and provides the video signals R', G', B' to the panel 130. Simultaneously, the timing controlling unit 325 converts the synchronizing signals V and H to synchronizing signals V' and H' and provides the synchronizing signals V', H' to the panel 130. The video signals R', G' and B' and synchronizing signals V' and H' are collectively referred to as a second image signal SIM2. The panel 130 then displays image frames corresponding to the second image signal SIM2.

Referring to FIGS. 2 and 4B, at time t1, the host 110 is informed to switch to a power-saving mode. The host 110 responsively sends a control signal Sctrl_1 to the arbiter 323 to start a process for preparing image data in the memory 121. In addition, the control signal Sctrl_1 also includes information relating to a predetermined amount that determines when to stop the preparation process. When the arbiter 323 receives the control signal Sctrl_1, it provides control signals Sctrl_2 and Sctrl_3 respectively to the data controlling unit 324 and the buffer controller 326 to notify the data controlling unit 324 to employ the video signals R', G' B' as image data D_image and transmit the image data D_image through the buffer controller 326 to the memory 121. In other words, the arbiter 323 receives synchronizing signals H, V from the host 110, and can derive the amount of the image data being stored in the memory 121 according to the synchronizing signals H, V. In other embodiments, the arbiter 323 may receive synchronizing signals H', V' rather than H, V to derive the amount of the image data stored in the memory.

Now turn to refer simultaneously to FIGS. 2 and 4C. At time t2, the arbiter 323 detects that the image data stored in the memory 121 reaches the predetermined amount indicated by the control signal Sctrl_1. Arbiter 321 immediately sends a control signal Sctrl_4 to the host 110 to direct the host 110 to stop generating the first image signal SIMI. Also, the arbiter 323 sends control signals Sctrl_5, Sctrl_6, and Sctrl_7 respectively to the buffer controller 326, the data controlling unit 324 and the timing controlling unit 325. The control signal Sctrl_5 informs the buffer controller 326 to transmit image data D_image (i.e. R', G, B' in the embodiment) from the memory 321 to the data controlling unit 324. The control signal Sctrl_6 informs the data controlling unit 324 to employ the image data D_image as the image information of the second image signal SIM2 and transmit it to the panel 130. And the control signal Sctrl_7 informs the timing controlling unit 325 to employ the predetermined timing controlling data D_timing stored therein as the timing controlling information of the second image signal SIM2 and transmit it to the LCD panel 130. The panel 130 then displays image frames corresponding to the image data D_image and the predetermined timing controlling data D_timing.

During the period T2, the frame rate of the image frames displayed by the panel 130 is controlled by the frame buffer 326 rather than the host 110. This is different from the period T1, during which the frame rate is controlled by the host 110. Preferably, the reading rate of the buffer controller 326 to read the image data from the memory 121 is adjustable such that the frame rate is also adjustable. In an embodiment, when the display device 100 operates in normal mode during period T1, the host 110 informs the arbiter 323 to preset the reading rate of the buffer controller 326. And then when the display device 100 operates in power saving mode, it transmits the image data from the memory 121 to the buffer controller 326 with the preset reading rate. As such, although image frames during T12 and T2 are the same, they can be displayed by the panel 130 with different frame rates. The frame rate is preferably lower than the reading rate used in normal mode to further reduce power consumption.

FIGS. 3 and 4*a*-4*c* also show an embodiment of the invention in which the host 110 informs the arbiter 323 to preset the reading rate. As shown in FIG. 3, a multiplexer 340 coupled with a plurality of reading clock signals Read_clock_1-Read_clock_n is connected between a clock input terminal of the buffer controller 326 and the arbiter 323. Referring to FIG. 4*b*, the control signal Sctrl_1 carries information that predetermines one of the reading clock signals Read_clock_1-Read_clock_n. After the arbiter 323 receives the signal Sctrl_1, it sets the multiplexer 340 to output the predetermined clock signal. Turning to FIG. 4*c*, the buffer controller 326 reads the image data R', G', B' from the memory with the predetermined reading rate set by the clock signal. As a result, the panel 130 displays image frames with a frame rate corresponding to the predetermined reading rate.

The display device operates in the power-saving mode until the host 110 is powered on to start generating the first image signal SIM1 again. To restore the display device 100 back to the normal mode, the host 110 sends a control signal (not shown) to the Arbiter 323. The arbiter 323 in response sends control signals (not shown) to the buffer controller 326, the data controlling unit 324 and the timing controlling unit 325 to notify them to perform the same operations in normal mode as in period T11.

Note that it is not required to store the predetermined timing controlling data in the timing controlling unit 325. For example, in other embodiments, the predetermined timing controlling data may be stored in a memory disposed outside the timing controlling unit 325 and is fetched by the timing controlling unit 325 in power-saving mode.

Additionally, it is not required to employ the image information R', G', B' of the second image signal SIM2 as the image data during period T12. For example, in another embodiment, the image information R, G, B of the first image signal SIM2 can be employed as the image data to transmit to the memory 121 during T12. And then in period T2, after the image data is transmitted from the memory 121 through the buffer controller 326 to the data controlling unit 324, it is required to be further converted to the image information R' G', B'.

Additionally, any required process can be additionally executed to convert the image information R', G', B' during period T12 or to convert the image data during period T2.

Additionally, it is not required to generate the image data according to one of the image signal SIM1 and SIM2 during period T12. For example, in other embodiments, image data different from the first image signal SIM1 or second image signal SIM2 can be generated additionally by the host 110 and then sent directly, or through the buffer controller 326, to the memory 121.

With the implementation of the memory 121 inside the timing controller 120 for storing image data, even when the host 110 is powered down, the panel 130 is still able to display image frames generated according to the image data. Meanwhile, the frame rate can be decreased to further reduce power consumption. Because the display device can be operated in the power-saving mode in which the host 110 is powered down and the frame rate can be reduced, it has lower power consumption compared to conventional display devices in which the host is powered continuously and the frame rate is maintained constant. Furthermore, the display device of the invention has a simple structure and thus high design flexibility.

While the invention has been described by way of examples and in terms of preferred embodiments, it is to be understood that the invention is not limited thereto. To the contrary, the invention is intended to cover various modifications and similar arrangements [as would be apparent to those skilled in the art]. Therefore, the scope of the appended claims should be accorded the broadest interpretation so as to encompass all such modifications and similar arrangements.

What is claimed is:

1. A display device, comprising:

a host adapted to generate a first image signal, the host being a video grid array (VGA) system;

a timing controller connected with the host and comprising a memory, wherein the timing controller is adapted to generate a second image signal for driving image display; and a panel connected with the timing controller, wherein the panel is adapted to receive the second image signal for displaying image frames;

wherein the host is configured to send a first control signal to the timing controller to trigger the start of a transition phase in preparation of a switch to a power-saving mode of operation, and to shut down once the transition phase ends, wherein the first control signal includes information related to a predetermined amount of image data to store in the memory;

in response to the first control signal, the timing controller is configured to store image data in the memory that are used for display by the panel in the power-saving mode of operation, and output a second control signal to the host when the image data stored in the memory during the transition phase reaches the predetermined amount, thereby ending the transition phase.

2. The display device of claim 1, wherein the image data that are stored in the memory for display by the panel in the power-saving mode of operation are generated according to the first or second image signal produced before the host is shut down.

3. The display device of claim 1, wherein the second image signal comprises image information and timing controlling information, and the image data that are stored in the memory for display by the panel in the power-saving mode of operation include the image information in the second image signal produced before the host is shut down.

4. The display device of claim 1, wherein in the power-saving mode of operation, the timing controller further acquires predetermined timing controlling data internally or externally, and generates the second image signal according to the predetermined timing data.

5. The display device of claim 1, wherein the host presets a reading rate of the image data from the memory before switching to the power-saving mode of operation.

6. The display device of claim 1, wherein the host stops generating the first image signal in response to the second control signal that ends the transition phase.

7. The display device of claim 6, wherein the timing controller checks the amount of the image data stored in the memory from timing controlling information in the first image signal.

8. The display device of claim 1, wherein the timing controller further comprises a buffer controller for controlling read data flow from the memory.

9. The display device of claim 8, wherein the buffer controller reads the image data from the memory according to an adjustable reading rate.

10. The display device of claim 8, wherein the host presets the reading rate of the buffer controller before switching to the power-saving mode of operation.

11. A timing controller, comprising a memory for storing image data, wherein the timing controller is configured to receive a first image signal from a host and to provide a second image signal to a panel for driving image display, the host being a VGA system;

receive a first control signal from the host that triggers the start of a transition phase in preparation of a switch to a power-saving mode of operation, wherein the first control signal includes information related to a predetermined amount of image data to store in the memory;

in response to the first control signal, storing image data in the memory that are used for display by the panel in the power-saving mode of operation; and sending a second control signal to the host when the image data stored in the memory during the transition phase reaches the predetermined amount, thereby ending the transition phase.

12. The timing controller of claim 11, wherein the image data that are stored in the memory for display by the panel in the power-saving mode of operation are generated according to the first or second image signal produced before the host is powered down.

13. The timing controller of claim 11, wherein the second image signal comprises image information and timing controlling information, and the image data that are stored in the memory for display by the panel in the power-saving mode of operation include the image information in the second image signal produced before the host is powered down.

14. The timing controller of claim 11, wherein in the power-saving mode of operation, the timing controller further acquires predetermined timing controlling data internally or externally, and generates the second image signal according to the predetermined timing data.

15. The timing controller of claim 11, wherein in the power-saving mode of operation, the image data are read from the memory according to a reading rate that is preset before the display device switches to the power-saving mode.

16. The timing controller of claim 11, wherein the second control signal outputted from the timing controller notifies the host to stop generating the first image signal and shut down.

17. The timing controller of claim 16, wherein the timing controller checks an amount of the image data stored in the memory from timing controlling information in the first image signal.

* * * * *